US006382873B1

(12) United States Patent
Mulders et al.

(10) Patent No.: US 6,382,873 B1
(45) Date of Patent: May 7, 2002

(54) SOIL LEVELLING DEVICE

(75) Inventors: David Alfred Mulders, Benoni; Gideon Slyper, Brakpan; Stephen Van Dyk, Germiston; Eric Cook, Nigel, all of (ZA)

(73) Assignee: Compaction Technology (Soil) Limited, Middlesex (GB)

( * ) Notice: Subject to any disclaimer, the term of this patent is extended or adjusted under 35 U.S.C. 154(b) by 0 days.

(21) Appl. No.: 09/051,581

(22) PCT Filed: Oct. 9, 1996

(86) PCT No.: PCT/GB96/02468

§ 371 Date: Dec. 11, 1998

§ 102(e) Date: Dec. 11, 1998

(87) PCT Pub. No.: WO97/13924

PCT Pub. Date: Apr. 17, 1997

(30) Foreign Application Priority Data

Oct. 13, 1995 (ZA) ..... 95/8658
Mar. 26, 1996 (ZA) ..... 96/2390

(51) Int. Cl.[7] ..... E01C 19/26; A01B 49/02

(52) U.S. Cl. ..... 404/128; 172/148; 172/175; 172/684.5

(58) Field of Search ..... 404/85, 86, 103, 404/128, 133.2; 172/148, 150, 175, 518, 684.5

(56) References Cited

U.S. PATENT DOCUMENTS 144,918 A * 11/1873 Moore ..... 172/148
975,580 A * 11/1910 Stebbins ..... 172/150
1,198,684 A * 9/1916 Waugh et al. ..... 172/138
1,273,654 A * 7/1918 Osborne ..... 172/684.5
2,664,683 A * 1/1954 de Cato ..... 404/86
3,966,346 A * 6/1976 Berrange ..... 404/124
4,043,694 A * 8/1977 Mullen ..... 404/133
4,422,795 A * 12/1983 Berrange ..... 404/124
4,989,676 A * 2/1991 Rogers ..... 172/438
5,244,306 A * 9/1993 Artzberger ..... 404/128
5,511,625 A * 4/1996 Mork ..... 172/445.1
5,562,365 A * 10/1996 Berrange ..... 405/271

FOREIGN PATENT DOCUMENTS

WO 94/26985 * 11/1994

* cited by examiner

*Primary Examiner*—Gary S. Hartmann
(74) *Attorney, Agent, or Firm*—Kilpatrick Stockton LLP

(57) ABSTRACT

The invention concerns a levelling device (10) for an impact roller of the type having at least one out-of-round compactor mass which, when caused to traverse a soil surface, applies periodic compacting blows to that surface. The levelling device of the invention is coupled to the impact roller so as to trail behind the impact roller. It includes a support frame (36) and, for each compactor mass of the impact roller, a ground-engaging levelling blade (52) fast with the support frame. The levelling blade is arranged to cut soil which has been traversed by the compactor mass and thereby to perform a soil levelling action. A ground-engaging shoe (58), one for each levelling blade, is connected to the support frame for pivotal movement about an axis transverse to the direction of movement of the impact roller The shoe serves to control the depth of cut achieved by the levelling blade.

12 Claims, 3 Drawing Sheets

SOIL LEVELLING DEVICE

This application is the national phase of international application PTC/GB96/02468, filed Oct. 9, 1996.

This invention relates to a soil levelling device to be used with an impact roller.

BACKGROUND TO THE INVENTION

The term "impact roller", as used initially in U.S. Pat. No. 2,909,106 refers to a soil compaction machine including a compactor mass of non-round shape which, when towed over a soil surface, produces a series of periodic blows on the soil surface. The compactor mass of an impact roller has a series of spaced apart, salient points on its periphery. Each such salient point is followed by compacting face with, in most cases, a re-entrant portion of the periphery between the salient point and the compacting face. As the impact roller is towed over the soil surface, for instance by means of a tractor, it rises up on each salient point and then falls forwardly and downwardly as it passes over that point, with the result that the following compacting face applies an impact blow to the soil surface. The coupling between the tractor and the compactor mass is resilient in nature to allow for the necessary forward and downward falling motion undergone by the mass as it passes over each salient point. In practice, as the compactor mass is moved over the soil surface, it produces a series of indentations in the soil surface which are spaced apart in the direction of movement of mass. The longitudinal spacing of the indentations is the same as the peripheral spacing of the compacting faces of the compactor mass. After one or several passes of the impact roller it is necessary to smooth the soil surface. This is typically done with the aid of a motor grader or, in some instances, using the blade of a bulldozer. In either case, the levelling operation requires a separate and expensive piece of equipment. Added to this the efficiency of the compaction operation is considerably reduced by the necessity for the use of levelling equipment after compaction has taken place. It has been proposed in WO 94/26985 to provide, in the case of an impact roller with two side by side compactor masses, a levelling blade arrangement which trails the compactor masses to apply a levelling action to the soil after passage of the compactor masses. With this proposal, it is possible to perform the levelling operation simultaneously with the compaction operation. It is an object of the present invention to provide a modified form of levelling device.

SUMMARY OF THE INVENTION

According to the present invention there is provided a soil levelling device for an impact roller, the levelling device comprising:

- coupling means for coupling the levelling device to the impact roller so as to trail the impact roller in use;
- a support frame;
- at least one compactor mass;
- for each compactor mass of the impact roller, a ground-engaging levelling blade fast with the support frame, the levelling blade being arranged to cut soil which has been traversed by the compactor mass and thereby to perform a soil levelling action; and
- for each levelling blade, a ground-engaging shoe connected to the support frame for pivotal movement relative to the support frame about an axis transverse to the direction of movement of the impact roller, the shoe serving to control the depth of cut achieved by the levelling blade.

Means are preferably provided which are operable to vary the elevation of the, or each, levelling blade relative to the support frame.

Typically, the device of the invention will be used with an impact compactor having two compactor masses spaced transversely apart from one another, the support frame carrying two transversely spaced apart levelling blades and two transversely spaced apart, ground-engaging shoes, one levelling blade and one shoe being provided for each compactor mass. The support frame will then include a transverse beam mounted for pivotal movement about a fore-and-aft axis, the levelling blades and shoes being supported in spaced apart relationship at opposite ends of the transverse beam.

The device may also comprise lifting and lowering means operable to raise and lower the support frame relative to the soil surface traversed in use by the levelling device. The lifting and lowering means may, for instance, comprise a double-acting hydraulic cylinder acting between the coupling means and a bracket to which the transverse beam is pivoted, the pressurisation of the hydraulic cylinder determining the force with which the levelling blades are biased into engagement with the soil surface. In one embodiment of the invention, there may be an hydraulic accumulator connected to the cylinder, the hydraulic accumulator serving to damp reaction forces on the levelling blades. In another embodiment, the cylinder may act via a pressurised air bag on the bracket to which the transverse beam is pivoted, the air bag serving to damp reaction forces on the levelling blades.

In the preferred embodiments, each around-engaging shoe has fore and aft portions which respectively lead and trail the associated levelling blade. In one version of the invention, the fore and aft portions of each shoe are in the form of skid, while in another version of the invention, the fore and aft portions of each shoe are in the form of rollers or groups of rollers. According to another aspect of the present invention there is provided a method of compacting and levelling a soil surface, the method comprising the steps of coupling a levelling device according to any one of the preceding claims to an impact roller and causing the impact roller to traverse the soil surface, with the levelling device trailing behind the impact roller, so that the impact roller applies periodic compacting blows to the soil surface and the levelling device then applies a levelling action to the soil surface.

BRIEF DESCRIPTION OF THE DRAWINGS

The invention will now be described in more detail, by way of example only, with reference to the accompanying drawings, in which.

DESCRIPTION OF EMBODIMENTS

Figure 1:
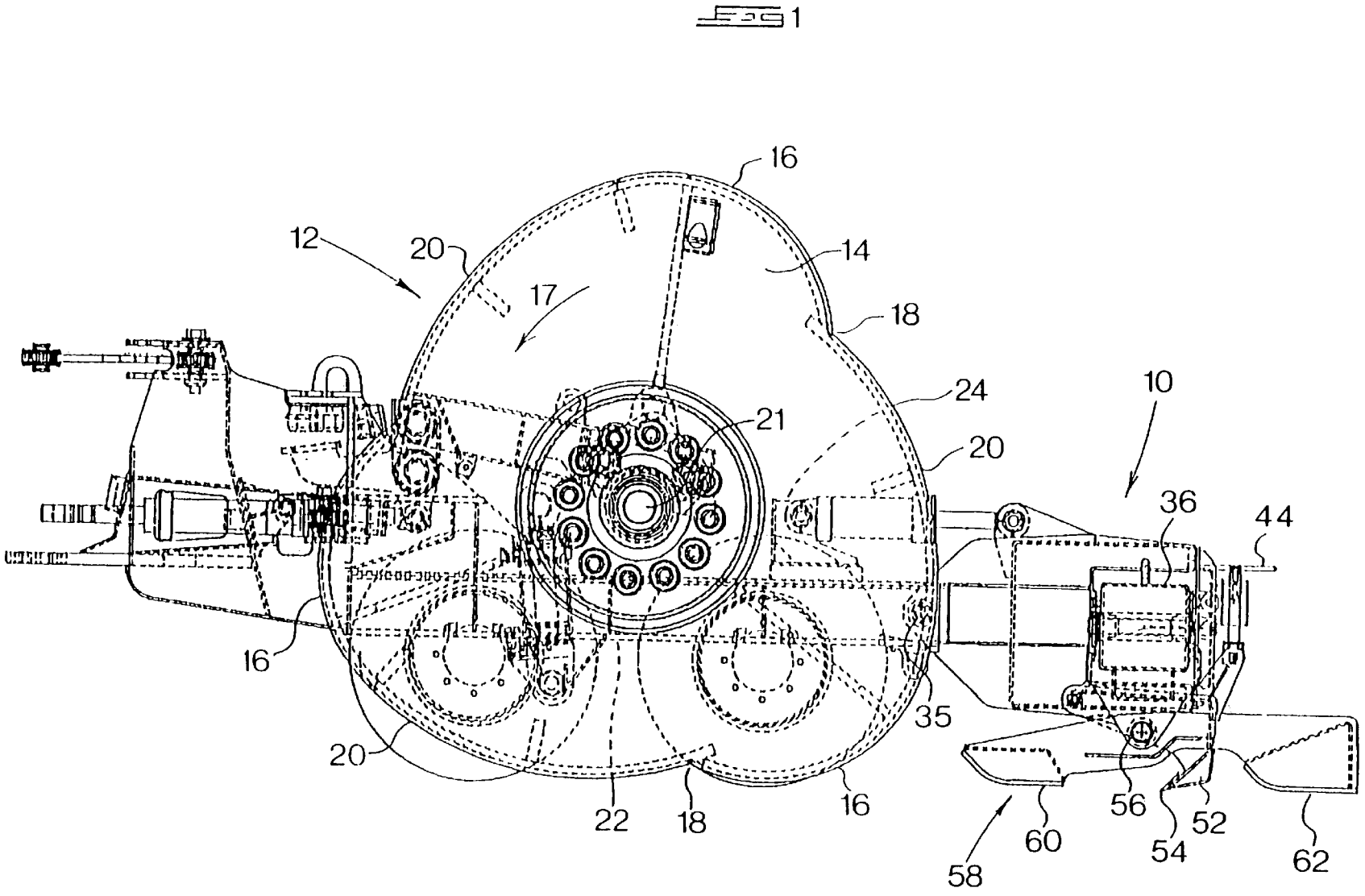
FIG. 1 shows a side view of a levelling device according to the invention coupled to a dual mass impact roller.

FIG. 1 illustrates a levelling device 10, according to one embodiment of the invention, coupled to a dual mass impact roller 12. The impact roller 12 is of conventional design and those skilled in the art of impact compaction will readily understand the operation thereof. For present purposes it suffices to say that the impact roller includes a pair of side-by-side compactor masses 14, only one of which is visible in the FIG. Each compactor mass has an out-of-round shape with a series of peripherally spaced salient points 16, each followed, for a direction of rotation 17, by a re-entrant portion 18 and a compacting face 20. The compactor masses 14 are spaced apart from one another and are mounted on a common axle 21 so as to rotate substantially in unison with one another. The axle is supported by a wheeled carriage 22.

The impact roller is coupled in use to a tractive vehicle such as a tractor (not illustrated). During towing, each compactor mass successively rises up on a salient point and then falls forwardly and downwardly for the following compacting face 20 to apply an impact blow to the soil surface, thereby compacting it. Thus it will be appreciated that the potential energy of each mass when it is raised up on a salient point is delivered to the soil surface at each impact blow.

Figure 2:
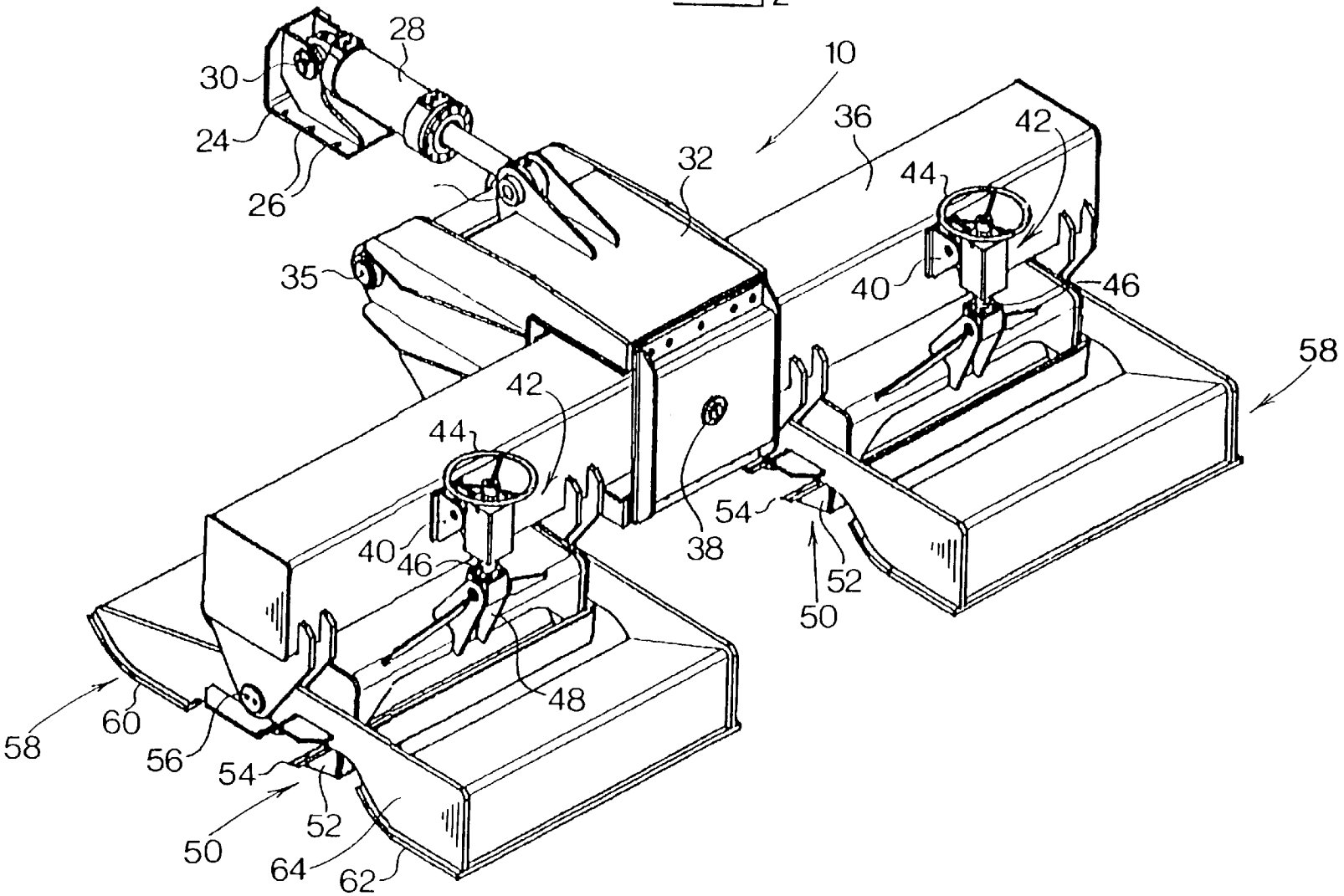
FIG. 2 shows an isometric view of the levelling device.

A coupling bracket 24 of the device 10 is bolted to the carriage 22 through bolt holes 26 (FIG. 2). One end of a double-acting hydraulic cylinder 28 is pivoted to the bracket 24 at an axis 30. The other end of the cylinder 28 is pivoted to a fulcrum bracket 32 at an axis 34. A transverse shaft 35 carried by the fulcrum bracket 32 is secured rotatably to the rear end of the carriage 22 as illustrated.

A transverse beam 36 extends through the fulcrum bracket 32 and is pivoted to the bracket 32 about a fore-and-aft axis 38. The overall length of the beam 36 is slightly greater than the spacing of the outer surfaces of the compactor masses 14.

The beam 36 carries brackets 40 towards either end as illustrated. Each bracket 40 supports a vertical adjustment mechanism 42 which is operated by a handwheel 44. The handwheel is used to rotate a threaded shaft 46 coupled via a bracket 48 at its lower end to a levelling blade assembly 50. Each levelling blade assembly includes an inclined, transverse levelling blade 52 with a cutting edge 54. It will be appreciated that the levelling blades are carried rigidly by the beam 36 and that rotation of the handwheels 44 serves to raise and lower the cutting edges of the blades relative to the beam.

Freely pivoted to the ends of the beam 36, at aligned pivot axes 56, are shoes 58. Each shoe has a front skid 60 and a rear skid 62 joined to one another by side plates 64. Each skid 60, 62 has an upwardly curved leading end as illustrated. The levelling blade assemblies 50 are located in the gap between the front and rear skids and the cutting edges 54 project donwardly below the lower extremities of the skids.

The centre to centre spacing of the levelling blades and skids matches the centre to centre spacing of the compactor masses 14 and the arrangement of the device 12 is such that the levelling blades track behind the compactor masses. During forward movement of the impact roller the skids 60, 62 contact and slide over the soil surface. They are able to rock freely about the pivot axis 56 to take account of irregularities in the soil surface. High points which are left in the soil surface between the indentations which are created by the action of the compactor masses are trimmed by the blades and the loose soil is then evenly distributed by the action of the blades and of the skids 62 so that a generally smooth soil surface is obtained after each pass by the impact roller.

The overall length of each shoe is typically such that, as it traverses an indentation in the soil created by the associated compactor mass, it will span across the indentation, thereby keeping the levelling blades 52 slightly elevated relative to the bottom of the indentation and assisting in the spreading of the loose soil cut from the preceding high point. The necessary downward force on the levelling blades to enable them to perform the desired cutting action is generated by appropriate pressurisation of the cylinder 28 to pivot the main assembly downwardly about the axis of the shaft 35.

It will be appreciated that, for a given setting of the handwheels 44, the levelling blades will project a given distance below the skids 60, 62. Since the skids 60, 62 are in contact with the soil surface, this distance determines the depth of cut achieved by the levelling blades. The depth of cut can of course be varied by appropriate rotation of the handwheels.

The beam 36 is able to pivot freely about the fore-and-aft axis 38 to take account of localised variations in the soil surface between one side and the other. The levelling blades 52 will generally have a transverse width which is slightly greater than the widths of the compactor masses, so as to perform a trimming operation both across the full width of the soil surface traversed by the compactor masses and for a short distance to either side thereof. The blades therefore apply a levelling action across the width of the indentations left by the compactor masses and for a short distance to each side thereof. The skids 60, 62 will have a width less than that of the blades so as to slide within the indentations left by the compactor masses.

Pressurised hydraulic fluid is supplied to the cylinder 28 from an hydraulic pump driven off the tractor or directly from the hydraulic system of the tractor. That working chamber of the cylinder 28 which is used to pressurise the cylinder to apply a downward bias to the levelling blades during levelling can be connected to an hydraulic accumulator (not illustrated) which acts as a damper to cushion the device 10 from shock loads which may arise if the levelling blades strike a hard obstacle such as a rock. For a given extension of the cylinder 28, the accumulator pressure determines the downward force on the levelling blade. By varying the accumulator pressure, this force can be varied as required.

At the end of a levelling operation or when levelling action is not required the cylinder 28 can be retracted to lift the shoes and levelling blades clear of the soil surface.

In FIG. 1 it will be seen that the cutting edges 54 of the levelling blades 52 are off-set slightly to the rear relative to the pivot axis 56.

It has been found that this off-set, in the context of the illustrated geometry of the levelling device, provides the device with an advantageous self-adjustment feature. When the shoe 58 is inclined donwardly, i.e. when the skid 60 is lower than the skid 62, the blade projects further beneath the skids to perform a deeper cutting action than when the shoe is inclined upwardly, i.e. the skid 60 is higher than the skid 62. With this feature, a substantial amount of soil can be cut by the blade, at appropriate locations, and transferred into the indentations left by the associated compactor mass. This facilitates the filling of each indentation with a sufficient quantity of soil for the formation of a smoothly compacted site. This feature of the illustrated design arises because the levelling blades are connected rigidly to the beam 36 while the shoes 58 are pivotally connected.

It will be appreciated that the illustrated device performs a soil levelling action immediately after passage by the compactor masses of the impact roller and can eliminate or reduce the requirement for a subsequent levelling action by a separate grader or other levelling machine. An important advantage is the provision of the shoes 58 which in general determine the depth of cut achieved by the levelling blades and which, with the illustrated geometry, allow for automatic variation of the cutting depth as they traverse indentations in the soil surface.

It will also be noted that the device is not an integral part of the impact roller itself, and can be attached or detached as required.

Figure 3:
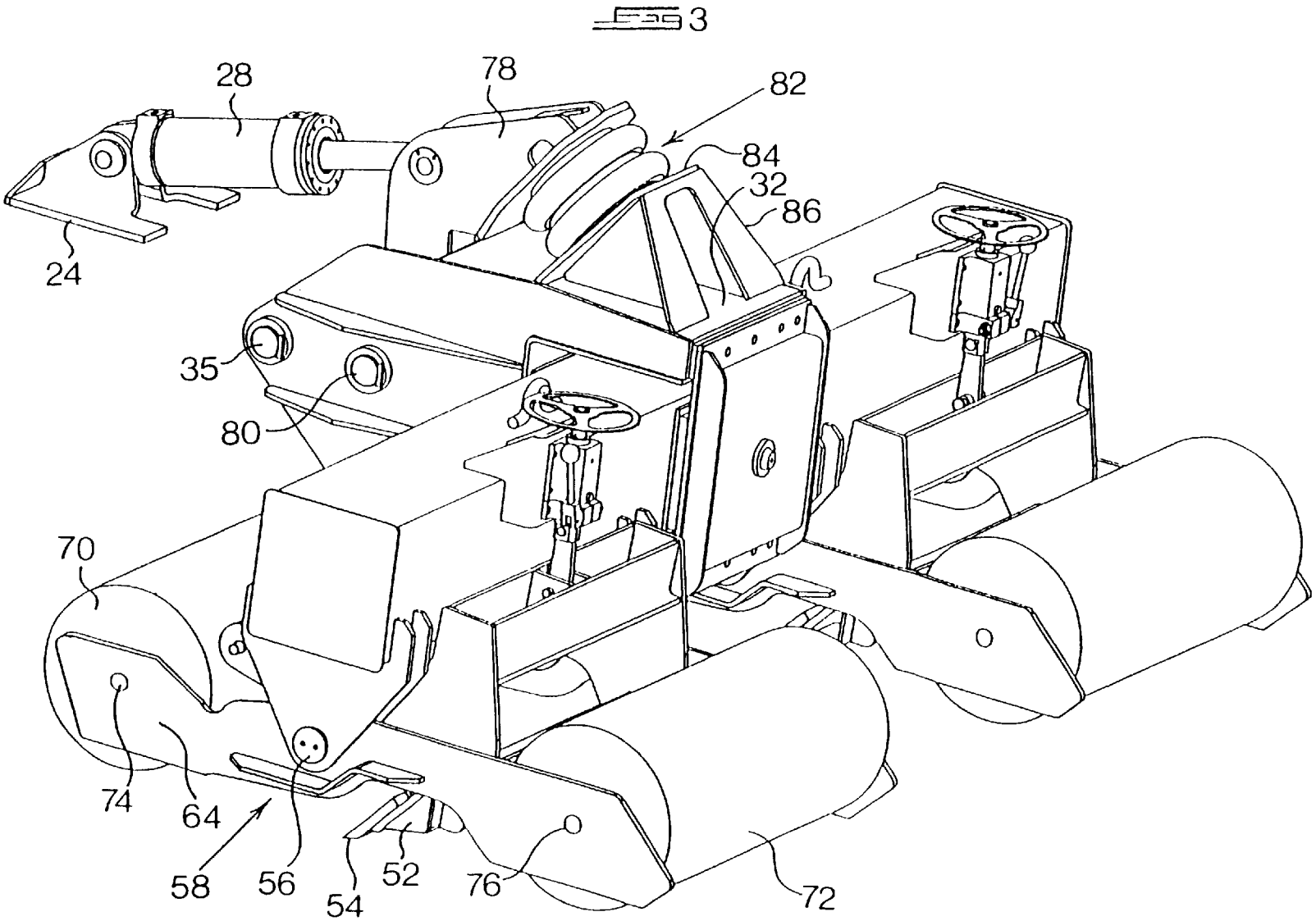
FIG. 3 shows an isometric view of another embodiment of the invention.

FIG. 3 illustrates a second embodiment of the invention. In this FIG. components corresponding to those seen in FIGS. 1 and 2 are indicated with the same reference numerals. One important difference between the embodiment of FIGS. 1 and 2 and that of FIG. 3 is the use, in FIG. 3, of shoes 58 which include fore and aft rollers, 70 and 72 respectively, instead of skids 60 and 62. The rollers 70 and 72 are freely rotatable on shafts 74 and 76 supported by the side plates 64.

In practice, the rollers 70 and 72 roll over the ground surface rather than sliding over that surface as is the case with the skids 60 and 62. It is believed that a rolling rather than a sliding action will be preferable in situations where the ground surface is composed of low friction material such as coal or shale fragments. Another advantage of the illustrated rollers as opposed to skids is the fact that the rollers, being of quite small radius and each having only a small portion of its cylindrical surface in contact with the ground at any one time, will be able to follow the ground contour created by the action of the compactor masses more accurately, and hence will be able to control the depth of cut achieved by the blades 52 with greater precision.

In FIG. 3 the rollers are illustrated as having smooth outer surfaces. In practice, to improve the purchase of the rollers on the ground and to reduce the chances of the rollers slipping over the ground surface as opposed to rolling over that surface, the roller surfaces may be roughened and may, for instance, include studs or other ground engaging projections.

It should also be noted that instead of each shoe having a single fore and a single aft roller, there may be multiple rollers grouped together fore and aft of the levelling blades.

Another important difference between the embodiment of FIGS. 1 and 2 and that of FIG. 3 is in the nature of the suspension of the soil levelling device. In FIG. 3 the double-acting hydraulic cylinder 28 is as before, pivoted to a bracket 24 which is bolted to the carriage of the impact roller. Also as in FIGS. 1 and 2, the fulcrum bracket 32 is pivotally connected to the carriage by a pivot shaft 35. In this case the cylinder acts on a lever 78. The lower end of the lever 78 is pivoted to the fulcrum bracket 32 at a pivot shaft 80 and its upper end acts on an air bag 82. Force is transmitted through the air bag 82 to the inclined surface 84 of a bracket 86 on the fulcrum bracket 32.

As in the first embodiment, the downward load with which the levelling blades are urged into engagement with the ground can be varied by varying the pressurisation of the cylinder 28. However, in this case, a damping effect to protect the levelling device from shock loads as a result of impacts with rocks and the like is provided by the air bag 82, the inflation pressure of which determines the magnitude of the damping effect. It is believed that in some cases at least the use of an air bag is preferable to the use of an hydraulic accumulator connected to the cylinder 28, since faster damping and restoration can be expected.

In FIG. 3, as in the first embodiment and for the same reasons mentioned above, the cutting edges 54 of the levelling blades 52 are off-set slightly to the rear of the pivot axis 56.

What is claimed is:

1. A soil levelling device for an impact roller having at least one compactor mass, the levelling device comprising:

coupling means for coupling the levelling device to an impact roller so as to trail the impact roller in use;

a support frame connected to the coupling means and including a transverse beam;

for each compactor mass of the impact roller, a ground-engaging levelling blade carried by the transverse beam, the levelling blade being arranged to cut soil which has been traversed by the compactor mass and thereby to perform a soil levelling action; and for each levelling blade, a ground-engaging shoe connected to the transverse beam for pivotal movement relative to the transverse beam about an axis transverse to the direction of movement of the impact roller, the shoe having fore and aft portions which lead and trail the levelling blade, whereby the shoe can follow the contour of a surface of the ground to control the depth of cut achieved by the levelling blade.

2. A levelling device according to claim 1 and comprising means operable to vary the elevation of the, or each, levelling blade relative to the transverse beam support frame.

3. A levelling device according to claim 1 for use with an impact roller having two compactor masses spaced transversely apart from one another, the transverse beam carrying two transversely spaced apart leveling blades and two transversely spaced apart, ground-engaging shoes, one levelling blade and one shoe being provided for each compactor mass.

4. A levelling device according to claims 3 wherein the transverse beam is mounted for pivotal movement about a fore-and-aft axis, the levelling blades and shoes being carried in spaced apart relationship at opposite ends of the transverse beam.

5. A levelling device according to claim 4 comprising lifting and lowering means operable to lift and lower the transverse beam relative to the soil surface traversed in use by the leveling device.

6. A levelling device according to claim 1 wherein each ground-engaging shoe has fore and aft portions which respectively lead and trail the associated leveling block, and wherein the fore and aft portions of each shoe are in the form of skids.

7. A levelling device according to claim 1 wherein each ground-engaging shoe has fore and aft portions which respectively lead and trail the associated leveling block, and wherein the fore and aft portions of each shoe are in the form of rollers or groups of rollers.

8. A soil levelling device for use with an impact compactor having two compactor masses spaced transversely apart from one another, the soil levelling device comprising:

coupling means for coupling the levelling device to an impact roller so as to trail the impact roller in use;

a support frame;

for each compactor mass of the impact compactor, a ground-engaging levelling blade fast with the support frame, the levelling blade being arranged to cut soil which has been traversed by the compactor mass and thereby to perform a soil levelling action;

for each levelling blade, a ground-engaging shoe connected to the support frame for pivotal movement relative to the support frame about an axis transverse to the direction of movement of the impact roller, the shoe serving to control the depth of cut achieved by the levelling blade; and wherein the support frame includes a transverse beam mounted for pivotal movement about a fore-and-aft axis, the levelling blades and shoes being supported in spaced apart relationship at opposite ends of the transverse beam.

9. A soil levelling device according to claim 8 and comprising means operable to vary the elevation of each levelling blade relative to the support frame.

10. A soil levelling device according to claim 8 comprising lifting and lowering means operable to raise and lower the support frame relative to the soil surface traversed in use by the levelling device.

11. A soil levelling device according to claim 10 wherein the lifting and lowering means comprises a double-action hydraulic cylinder acting between the coupling means and a bracket to which the transverse beam is pivoted, the pressurization of the hydraulic cylinder determining the force with which the levelling blades are biased into engagement with the soil surface.

12. A soil levelling device according to claim 11 wherein the double-acting hydraulic cylinder acts via a pressurized air bag on the bracket to which the transverse beam is pivoted, the air bag serving to damp reaction forces on the levelling blades.

* * * * *